US007886929B2

(12) United States Patent
L'helgoualc'h et al.

(10) Patent No.: US 7,886,929 B2
(45) Date of Patent: Feb. 15, 2011

(54) DEVICE FOR STORING AND DISPENSING ENDLESS MACHINING BELTS FOR A ROBOTIC INSTALLATION

(75) Inventors: Carole L'helgoualc'h, Versailles (FR); Paul Alexandre Pereira, Juvisy sur Orge (FR)

(73) Assignee: SNECMA, Paris (FR)

( * ) Notice: Subject to any disclaimer, the term of this patent is extended or adjusted under 35 U.S.C. 154(b) by 295 days.

(21) Appl. No.: 12/016,757

(22) Filed: Jan. 18, 2008

(65) Prior Publication Data

US 2008/0173660 A1 Jul. 24, 2008

(30) Foreign Application Priority Data

Jan. 18, 2007 (FR) ..... 07 00323

(51) Int. Cl.
*B65H 1/00* (2006.01)

(52) U.S. Cl. ..... 221/122; 221/92

(58) Field of Classification Search ..... 221/1, 221/2, 4, 5, 9, 10, 11, 13, 14, 22, 25, 69, 221/76, 87–89, 92, 103, 110, 112–115, 119–124, 221/129–133, 156, 163, 164, 166, 167, 186, 221/190, 312 R See application file for complete search history.

(56) References Cited

U.S. PATENT DOCUMENTS

| | | | | |
|---|---|---|---|---|
| 4,314,524 | A * | 2/1982 | Deguchi | 118/54 |
| 4,613,277 | A * | 9/1986 | Guay | 414/729 |
| 4,725,191 | A * | 2/1988 | Eberle et al. | 414/744.5 |
| 4,757,458 | A * | 7/1988 | Takemoto et al. | 700/254 |
| 4,946,337 | A * | 8/1990 | Tonai et al. | 414/744.5 |
| 5,201,617 | A * | 4/1993 | Delaval et al. | 409/131 |
| 5,256,128 | A * | 10/1993 | Neumann | 483/1 |
| 6,224,121 | B1 * | 5/2001 | Laubach | 294/86.4 |
| 2009/0011691 | A1 * | 1/2009 | L'helgoualc'h et al. | 451/296 |

FOREIGN PATENT DOCUMENTS

| | | | |
|---|---|---|---|
| FR | 2 677 289 | A1 | 12/1992 |
| FR | 2677289 | A1 * | 12/1992 |
| JP | 10-156694 | | 6/1998 |

* cited by examiner

*Primary Examiner*—Gene Crawford
*Assistant Examiner*—Kelvin L Randall, Jr.
(74) *Attorney, Agent, or Firm*—Oblon, Spivak, McClelland, Maier & Neustadt, L.L.P.

(57) ABSTRACT

A device for storing and dispensing endless machining belts for a robotic installation is disclosed. The device includes a support rotating about a vertical axis and having radial arms. Each arm is equipped with means for locating a machining belt, and means for controlling stepwise rotation of the rotating support, in order to bring each arm in turn to a position where the belt may be fitted onto a robot arm.

8 Claims, 3 Drawing Sheets

DEVICE FOR STORING AND DISPENSING ENDLESS MACHINING BELTS FOR A ROBOTIC INSTALLATION

BACKGROUND OF THE INVENTION

This invention relates to a device for storing and dispensing endless machining belts, especially grinding belts, for a machining installation comprising a robot arm.

The robot arm is equipped with one or more machining belts which must be regularly replaced to change the type of belt used or to replace a worn belt with a new one.

DESCRIPTION OF THE PRIOR ART

Document FR-A1-2677289 discloses a machining installation comprising a dispenser of endless grinding belts comprising a plurality of belt support platforms mounted in a vertical cage with a vertical and horizontally mobile system for extending the platforms from the cage one after the other toward a robot arm. One problem with that dispenser is its complexity and the large number of operations that have to be carried out to change one abrasive belt on the robot, with the result that belt changes are time-consuming and can require the intervention of an operator.

SUMMARY OF THE INVENTION

It is a particular object of the invention to provide a simple, effective and inexpensive solution to this problem.

To this end, the invention provides a device for storing and dispensing endless machining belts for a robotic installation, comprising means for supporting a plurality of machining belts and means for locating these belts on the supporting means, in which device the supporting and locating means comprise a support rotating about a vertical axis and having radial arms, each equipped with means for locating a machining belt, and means for the stepwise rotation of the rotating support, in order to bring each arm in turn to a station where the belt may be fitted onto a robot arm.

The star configuration of the device of the invention means that changing a belt on a robot arm takes little time and very few operations, because all that is required is to rotate the support of the radical arms a fraction of a revolution to present a new belt in a position where this belt can be picked up by the robot arm.

The device comprises for example twelve radial arms set out at regular intervals around the vertical axis.

In accordance with another feature of the invention, the belt locating means comprise retractable pins guided in housings in the arms and engaged in the ends of the belts, and return springs urging these pins toward their belt holding position.

The locating pins are engaged in the belt carried by the radial arm and make it possible to keep this belt in a position in which the belt is slightly tensioned, so that the belts are stored on the radial arms in the same position. It is therefore no longer necessary for an operator to check that the belts are correctly positioned in the device. The retractable pins are permanently urged by the return springs toward their belt holding position.

The top ends of the belt locating pins form contact surfaces that are pushed by the bottom ends of two pulleys of a robot arm to depress the pins and engage the belt on the pulleys of the robot.

The fitting of a belt to the robot arm is done automatically by placing the robot arm in such a way that the pulleys push down on the pins to depress the pins and release a belt. The pulleys of the robot arm which are engaged in the ends of the belt are then moved further apart from each other so that the belt is tensioned between the pulleys. The robot arm can then move away with the belt to perform machinery operations.

Each radial arm may comprise for example an elongate plate supporting the edges of a belt and comprising orifices at its ends for the locating pins to pass through.

This plate preferably comprises an elongate guide slot extending between the two edges of the belt, to allow the descent of part of the robot arm and facilitate the positioning of the latter when the pulleys of the arm are being moved apart from one another.

The device preferably comprises at least one sensor for detecting the presence of machining belts on the radial arms. The sensor can detect the presence of a belt on the radial arm present in the station where belts are fitted to the robot arm. If this radial arm is not carrying a belt, the rotating support is turned one step so that a new radial arm is situated in the fitting station and the sensor can detect the presence of a belt on this arm. If there is still no belt, the operation is repeated until a belt is found in the fitting station.

An operator can intervene on the device to install new belts. This operation may also be carried out by an automatic unit.

DESCRIPTION OF THE DRAWINGS

The invention will be understood more clearly and other advantages and features of the invention will become apparent from the following description, which is given by way of non-restrictive example with reference to the appended drawings in which.

DESCRIPTION OF THE PREFERRED EMBODIMENTS

Figure 1:
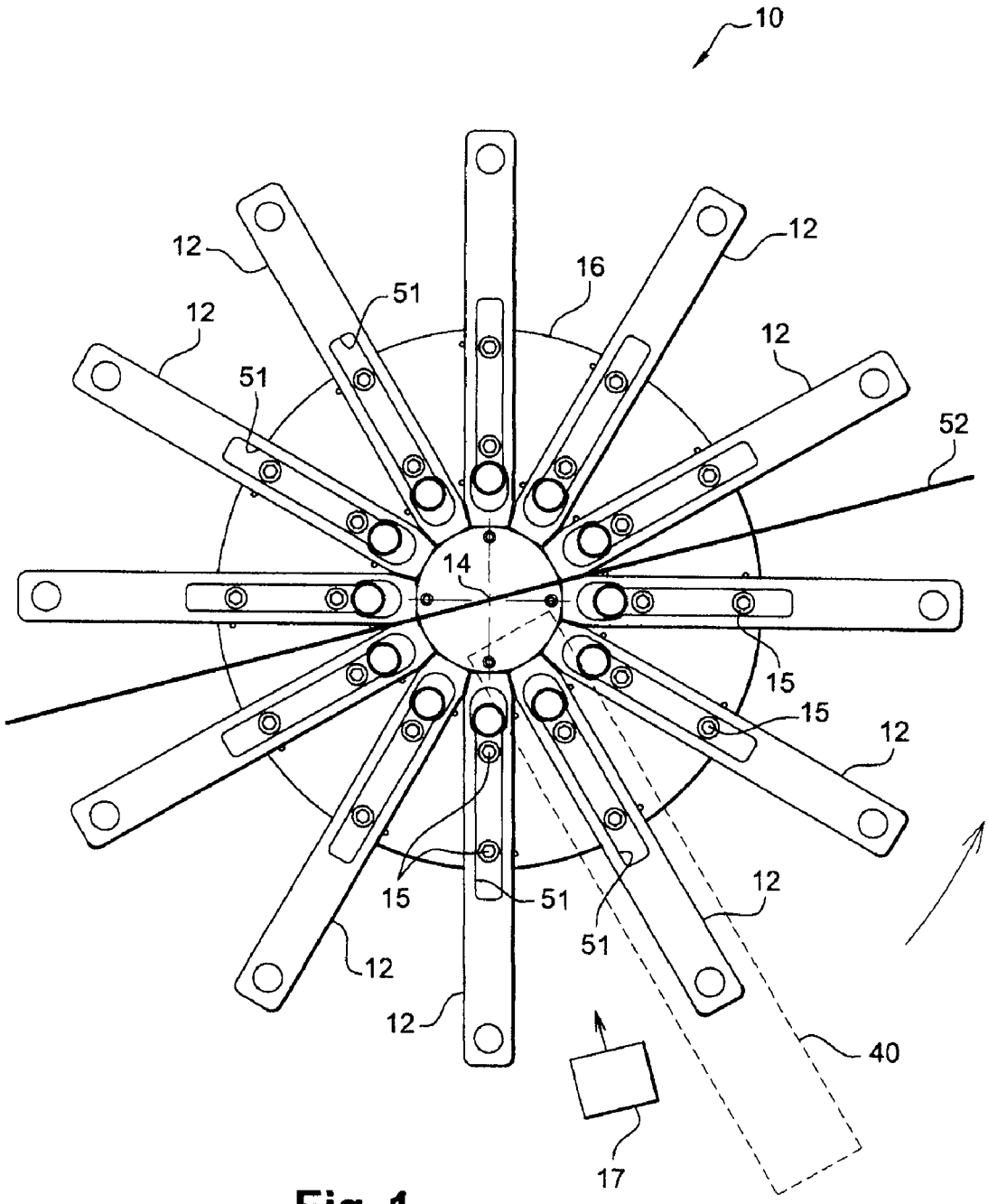
FIG. 1 is a schematic top view of the device for storing and dispensing endless machining belts according to the invention.

Referring initially to FIG. 1, this shows in schematic form an embodiment of the device 10 according to the invention for storing and dispensing endless machining belts for a machining installation comprising a robot arm 40.

The device 10 comprises a plurality of belt supporting and locating arms 12 that extend radially around a vertical axis 14 and that are distributed at regular intervals about this axis 14. The radial arms 12 are fixed by screws 15 or the like to a circular platform 16 rotated stepwise about the axis 14 by drive means. The device also includes a base for supporting and guiding the rotary platform 16.

In the example illustrated, the radial arms 12 are twelve in number and the platform is turned stepwise in steps of 30°.

The machining belts may be of any type such as grinding belts for example. Belts mounted on the robot arm 40 must be replaced at regular intervals, especially to replace a worn belt with a new one. The stepwise rotation of the platform 16 is controlled by a robot arm control unit so that the platform is rotated in response to the needs of the robot arm for belts.

The device also includes one or more detectors 17 for detecting the presence of belts on the radial arms 12: these detectors transmit signals to the robot arm control unit.

Each radial arm 12 (more clearly visible in FIGS. 2 and 3) comprises means for supporting a belt 18 and means for locating this belt on the support means in such a way that the belt can be picked up directly by the robot arm without operator assistance.

The locating means comprise an elongate parallelepiped-shaped box 20 having a large upper face 22 at whose longitudinal ends are two orifices 24 for two retractable cylindrical pins 26 to pass through. The belt 18 will be wrapped around these pins 26.

The pins 26 are approximately parallel to and at a distance from each other, the distance between the pins being such that the belt 18 wrapped around the pins is in an elongated or slightly tensioned condition in which it comprises two long belt portions that are approximately straight, mutually parallel, and close together.

Return springs (represented schematically by dashes 28) are held inside the box 20 and extend between the bottom face of the box and the bottom ends of the pins 24 so as to tend to push these pins out of the box, into their belt holding position. Means are provided to limit the movement of the pins into and out of the box, through the orifices 24.

The top ends of the pins 26 form contact surfaces on which a robot arm can push, as will be described later in more detail.

The means of supporting a belt on the radial arm 12 comprise a flat elongate plate 30 whose dimensions in terms of breadth and length are approximately the same as those of the upper face 22 of the box 20, and which is fixed over the top of and at a distance from this face by means of screws 32. The distance between the plate 30 and the face 22 of the box is determined for example by tubes 34 of predetermined length engaged around the screws and mounted between the plate 30 and the upper face 22 of the box 20.

At the longitudinal ends of the plate 30 are two orifices 36 for the pins 26 to pass through, the inside diameter of these orifices being greater than the outside diameter of the pins.

The pins 26 can be moved axially between first and second positions and are permanently urged toward the first position by the return springs 28.

Figure 2:
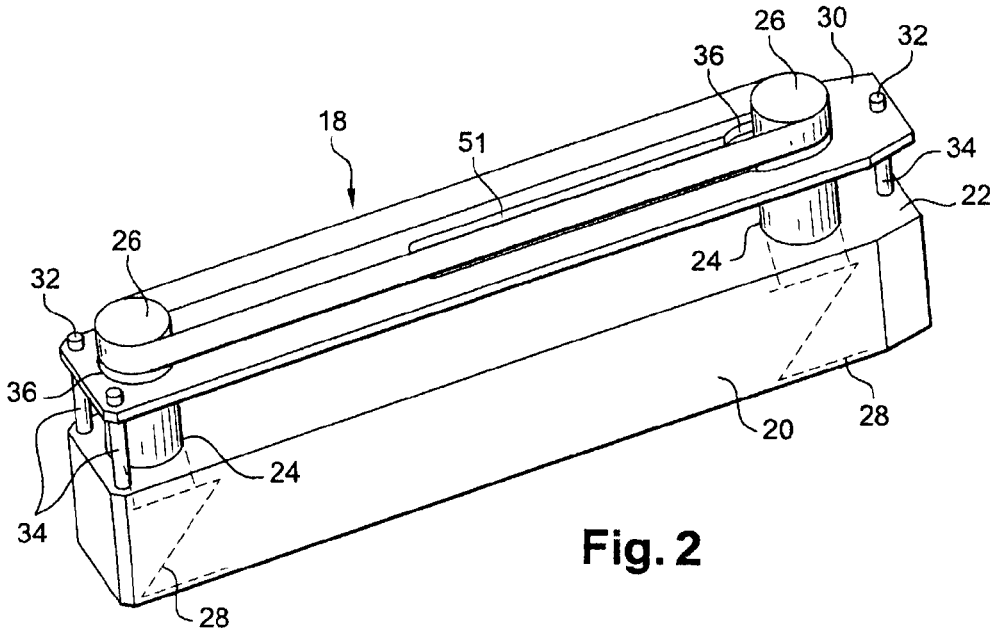
FIGS. 2 and 3 are schematic perspective views of a radial arm of the device seen in FIG. 1.

In the first position, shown in FIG. 2, the top end parts of the pins 26 pass through the orifices 36 of the plate 30 and project above this plate. In this position the pins are engaged in the machining belt 18 placed on the plate 30 and keep this belt in an elongate or slightly tensioned condition.

Figure 3:
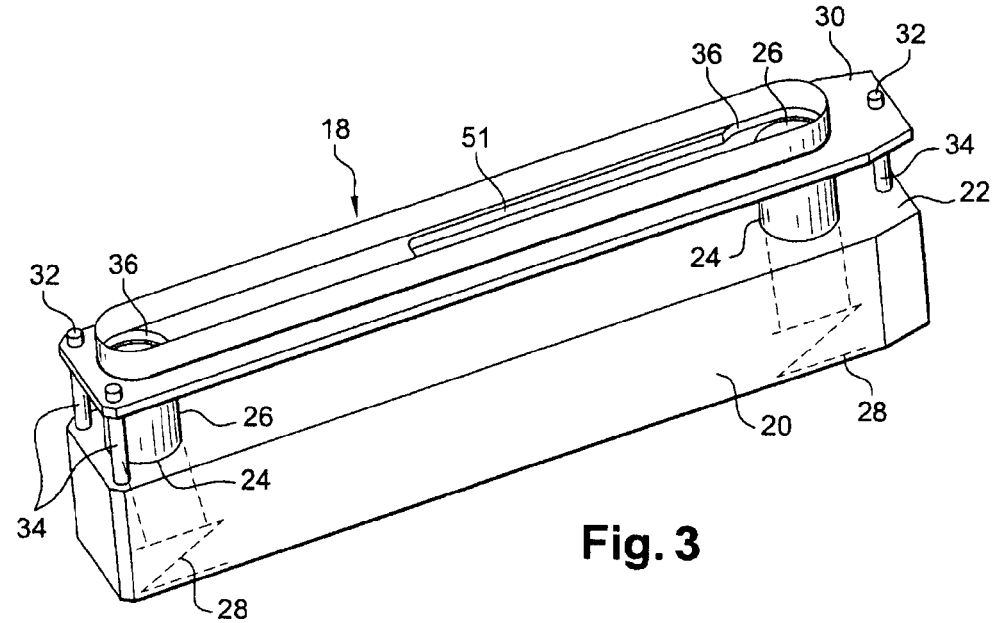

In the second position, shown in FIG. 3, the pins 26 have been pushed down beneath the plate 30 and are no longer engaged in the belt 18, which is resting on the plate and is therefore free to be picked up by a robot arm. The distance between the plate and the box 20 is such that the pins no longer project above the plate when the pins are in their second position.

Figure 5:
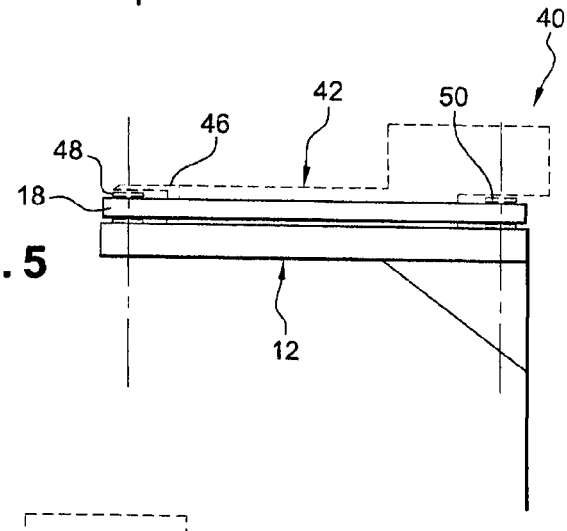
Figure 6:
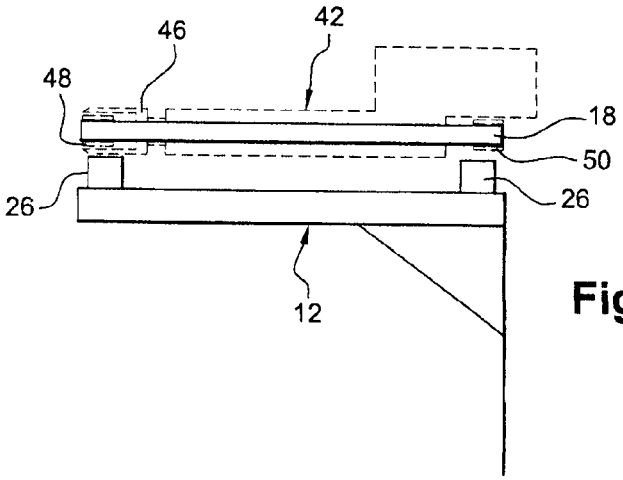

As will be described in more detail below with reference to FIGS. 4-6, the movement of the pins from their first position to their second is caused mechanically by the robot arm.

Figure 4:
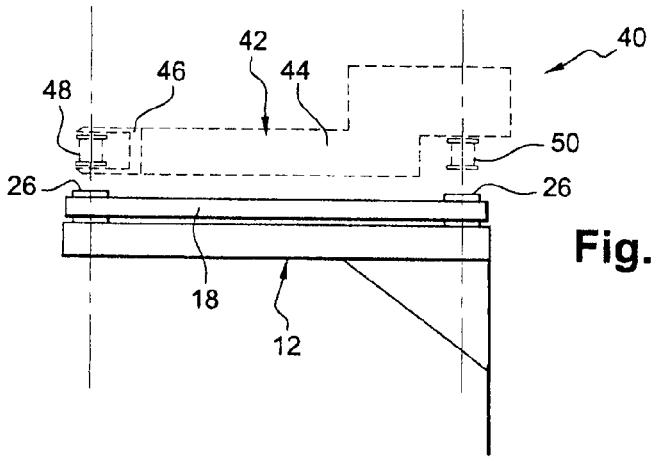
FIGS. 4-6 are highly schematic side views of a radial arm of the device according to the invention, and illustrate steps in a process of fitting a belt to a robot arm.

The robot arm 40, shown partially and highly schematically in FIG. 4, comprises an actuator 42 whose cylinder 44 is mounted on the robot arm and whose piston 46 is connected to a driven pulley 48 mounted so as to rotate freely on a spindle perpendicular to the longitudinal axis of the actuator. The robot arm also has a drive pulley 50 which extends parallel to the first pulley, behind the actuator, and whose axis is parallel to the axis of the actuator 42. This pulley 50 is turned by a motor mounted on the robot arm.

In a first step of fitting a belt 18 to the robot arm, shown in FIG. 4, the actuator 42 of the robot arm is in a retracted position in which the distance between the axes of the pulleys 48, 50 is approximately equal to the distance between the axes of the pins 26. The robot arm 40 is positioned above a radial arm 12 of the device on which a belt is fitted (FIG. 1), until the pulleys 48, 50 are aligned with the pins 26. The robot arm 40 is then moved vertically toward the radial arm 12 until the pulleys 48, 50 of the robot arm engage in the belt 18 and move the pins 26 from their first position to their second by pushing on the top ends of the pins (FIG. 5). The piston 46 of the actuator is then extended to move the pulleys 48, 50 further apart until the belt 18 is tensioned between the pulleys. The belt can then be removed to carry out machining work (FIG. 6). The pins 26 are returned to their first position by the return springs 28. A new belt 18 can be placed on the pins 26 by an operator or by an automatic unit.

The control unit of the robot arm controls the movement of the robot arm and of the platform 16 in response to information transmitted by the sensor 17. The platform 16 is driven stepwise about the axis 14 until a radial arm 12 fitted with a belt is in a predetermined belt pick-up position, so that the belt can be fitted on the robot arm by carrying out the steps shown in FIGS. 4-6.

As is visible in FIGS. 1-3, the plate 30 of each radial arm 12 may include an elongate slot 51 extending along the edges of the belt 18 and connected at one end to one of the aforementioned orifices 36 through which the pins 26 can pass, in such a way as to facilitate the engagement of the actuator 42 of the robot arm in the belt 18 and guide the actuator piston 46 as it extends.

In one particular illustrative embodiment of the invention, the device also comprises a vertical wall 52 separating the device shown in FIG. 1 into two groups of six radial arms each, one group being accessible to one robot arm 40 and the other group being accessible to an operator for the purpose of installing new machining belts. Each time the platform 16 turns one step about the axis 14, one of the radial arms 12 of the first group moves into the second group, and one of the arms 12 of the second group moves into the first group.

The invention claimed is:

1. A device for storing and dispensing endless machining belts for a robotic installation, comprising:

means for supporting a plurality of machining belts and means for locating the belts on the supporting means, the supporting and locating means comprise a support rotating about a vertical axis and having radial arms, each arm equipped with means for locating a machining belt; and means for controlling the stepwise rotation of the rotating support, in order to bring each arm in turn to a position where the belt may be fitted onto a robot arm.

2. The device as claimed in claim 1, wherein the locating means comprise retractable pins guided in housings in the arms and engaged in the ends of the belts, and return springs which urge the pins toward a belt holding position.

3. The device as claimed in claim 2, wherein top ends of the belt locating pins form contact surfaces that are pushed by bottom ends of two pulleys of a robot to depress the pins and engage the belt on the pulleys of the robot.

4. The device as claimed in claim 2, wherein the belt is slightly tensioned when positioned on the retractable pins.

5. The device as claimed in claim 2, wherein each radial arm comprises an elongate plate supporting the edges of the belt and comprising orifices at its ends for the locating pins to pass through.

6. The device as claimed in claim 5, wherein the plate comprises an elongate slot extending between the two edges of the belt, for the descent of part of the robot.

7. The device as claimed in claim 1, comprising twelve radial arms.

8. The device as claimed in claim 1, comprising at least one sensor for detecting the presence of machining belts on the radial arms.

* * * * *